US008648785B2

(12) United States Patent
Ooishi et al.

(10) Patent No.: US 8,648,785 B2
(45) Date of Patent: Feb. 11, 2014

(54) DISPLAY DEVICE FOR CALCULATING AND SUPPLYING A PRECHARGE POTENTIAL

(75) Inventors: Yoshihisa Ooishi, Yokohama (JP); Goki Toshima, Chiba (JP); Junichi Maruyama, Mobara (JP); Misa Owa, Kokubunji (JP)

(73) Assignees: Japan Display Inc., Tokyo (JP); Panasonic Liquid Crystal Display Co., Ltd., Hyogo-ken (JP)

( * ) Notice: Subject to any disclaimer, the term of this patent is extended or adjusted under 35 U.S.C. 154(b) by 404 days.

(21) Appl. No.: 13/050,981

(22) Filed: Mar. 18, 2011

(65) Prior Publication Data

US 2011/0234648 A1 Sep. 29, 2011

(30) Foreign Application Priority Data

Mar. 23, 2010 (JP) ..... 2010-067064

(51) Int. Cl.
*G09G 3/36* (2006.01)

(52) U.S. Cl.
USPC ..... 345/95; 345/98

(58) Field of Classification Search
USPC ..... 345/87–103
See application file for complete search history.

(56) References Cited

U.S. PATENT DOCUMENTS 6,344,850 B1 2/2002 Okumura et al.
7,403,176 B2 * 7/2008 Chung et al. ..... 345/76
7,446,745 B2 * 11/2008 Morita ..... 345/92
7,675,508 B2 * 3/2010 Imai et al. ..... 345/175
2008/0204376 A1 * 8/2008 Baek et al. ..... 345/76
2009/0102766 A1 4/2009 Oke et al.
2010/0231617 A1 9/2010 Ueda et al.

FOREIGN PATENT DOCUMENTS

| | | |
|---|---|---|
| CN | 101645256 | 2/2010 |
| JP | 04-307592 | 10/1992 |
| JP | 2000-20031 | 1/2000 |
| JP | 2003-263135 | 9/2003 |
| JP | 2005-338494 | 12/2005 |
| JP | 2008-209890 | 9/2008 |
| WO | WO 2009/060656 | 5/2009 |

* cited by examiner

*Primary Examiner* — Chanh Nguyen
*Assistant Examiner* — Roy Rabindranath
(74) *Attorney, Agent, or Firm* — Antonelli, Terry, Stout & Kraus, LLP.

(57) ABSTRACT

Provided is a display device including: a control portion; a display panel including one or more pixel circuits and an image signal line connected to the pixel circuits; and an image signal line driving circuit. The control portion includes a difference acquiring circuit for acquiring difference data between a value of a gray-level potential, which is to be applied to one of the pixel circuits from the image signal line, and a value of a precharge potential based on the gray-level potential. The image signal line driving circuit calculates the precharge potential based on the value of the gray-level potential and the difference data, and supplies the image signal line with the precharge potential and the gray-level potential in sequence.

12 Claims, 10 Drawing Sheets

| | | DD (n, m) | | | | | | | | |
|---|---|---|---|---|---|---|---|---|---|---|
| | | 0 | 32 | 64 | 92 | 128 | 160 | 192 | 224 | 255 |
| DD (n-1,m) | 0 | 0 | 40 | 74 | ··· | | | ··· | 260 | ··· |
| | 32 | -10 | 32 | ··· | | | | | | |
| | 64 | -12 | ··· | 64 | ··· | | | | | |
| | 92 | ··· | | ··· | 92 | ··· | | | | |
| | 128 | | | | ··· | 128 | ··· | | | |
| | 160 | | | | | ··· | 160 | ··· | | |
| | 192 | | | | | | ··· | 192 | ··· | |
| | 224 | | | | | | | ··· | 224 | ··· |
| | 255 | | | | | | | | ··· | 255 |

FIG.8

| | | DD (n, m) | | | | | | | | |
|---|---|---|---|---|---|---|---|---|---|---|
| | | 0 | 32 | 64 | 92 | 128 | 160 | 192 | 224 | 255 |
| DD (n-1, m) | 0 | 0 | 8 | 10 | ··· | | | ··· | 36 | ··· |
| | 32 | -8 | 0 | ··· | | | | | | |
| | 64 | -10 | ··· | 0 | ··· | | | | | |
| | 92 | ··· | | ··· | 0 | ··· | | | | |
| | 128 | | | | ··· | 0 | ··· | | | |
| | 160 | | | | | ··· | 0 | ··· | | |
| | 192 | | | | | | ··· | 0 | ··· | |
| | 224 | | | | | | | ··· | 0 | ··· |
| | 255 | | | | | | | | ··· | 0 |

DISPLAY DEVICE FOR CALCULATING AND SUPPLYING A PRECHARGE POTENTIAL

CROSS-REFERENCE TO RELATED APPLICATION

The present application claims priority from Japanese application JP 2010-067064 filed on Mar. 23, 2010, the content of which is hereby incorporated by reference into this application.

BACKGROUND OF THE INVENTION

1. Field of the Invention

The present invention relates to a display device in which a plurality of pixel circuits are arranged on a substrate and each of the pixel circuits displays a gray level.

2. Description of the Related Art

There is a display device, exemplified by a liquid crystal display device, in which pixel circuits are arranged in matrix on a substrate and each of the pixel circuits displays a gray level. In the display device, the pixel circuits in each column are connected to a corresponding image signal line. The image signal line is applied with a gray-level potential corresponding to a display gray level from an image signal line driving circuit, and the image signal line supplies the potential of the image signal line in succession to the pixel circuits connected thereto. Meanwhile, with the recent increase in resolution and frames per second, each pixel circuit is applied with the potential for a shorter period (horizontal period). This causes a troublesome phenomenon that, when the image signal line is applied with the gray-level potential, a large difference occurs between a target gray-level potential and a potential of the image signal line reached in the horizontal period. This phenomenon changes a potential to be applied to the pixel circuit with the result that, for example, a different gray level from an intended gray level is displayed.

A known method for reducing the phenomenon is a technology called overdrive. Ina display device that implements the overdrive, the image signal line is supplied with a potential obtained by correcting the gray-level potential. More specifically, the potential obtained by correcting the gray-level potential is generated based on a gray-level potential to be supplied to a certain pixel circuit and a potential of the image signal line prior to the timing of supplying the gray-level potential. The generated potential is then supplied to the image signal line. When the thus corrected potential is applied to the image signal line in a horizontal period 1H, a potential of the image signal line comes close to the gray-level potential more quickly as compared with when the gray-level potential is applied as it is. At the end of the horizontal period 1H, the image signal line has a potential closer to the gray-level potential. Further, in the display device that implements the overdrive, a value of the potential obtained by correcting the gray-level potential is calculated by a control board that is provided separately from a liquid crystal display panel. The calculated value of the potential obtained by correcting the gray-level potential is input to the image signal line driving circuit from the control board. The image signal line driving circuit generates a potential based on the value (performs digital to analog conversion), and applies the potential obtained by correcting the gray-level potential to the image signal line.

Japanese Patent Application Laid-open No. 2008-209890 discloses a display device in which a potential obtained by correcting a gray-level potential as described above is supplied to the image signal line.

SUMMARY OF THE INVENTION

As one of the methods of supplying the corrected potential to the image signal line, exemplified by the overdrive, there is conceived a method in which, during a period of supplying a potential to a certain pixel circuit, the corrected potential (hereinafter, referred to as precharge potential) and the gray-level potential are supplied to the image signal line in succession. With this method, the image signal line is expected to have a potential closer to the gray-level potential. The use of this technology requires a need to input both a value of the precharge potential and a value of the gray-level potential to the image signal line driving circuit. In other words, the amount of information to be input to the image signal line driving circuit is increased. Hence, some problems such as the increased width of a bus connected to the image signal line driving circuit occur to make it difficult to configure a circuit for inputting data to the image signal line driving circuit.

The present invention has been made in view of the above-mentioned problems, and it is therefore an object thereof to provide a display device capable of suppressing an increase in amount of information to be input to an image signal line driving circuit.

Representative aspects of the invention disclosed herein are briefly summarized as follows.

(1) A display device, including: a control portion; a display panel including one or more pixel circuits and an image signal line connected to the pixel circuits; and an image signal line driving circuit, in which: the control portion includes a difference acquiring circuit for acquiring difference data between a value of a gray-level potential, which is to be applied to one of the pixel circuits from the image signal line, and a value of a precharge potential based on the gray-level potential; and the image signal line driving circuit includes: a calculating section for calculating the value of the precharge potential based on the value of the gray-level potential and the difference data; and an image signal line output section for supplying the image signal line with the precharge potential and the gray-level potential in sequence based on a calculation result of the calculating section.

(2) The display device according to item (1), in which the display panel includes a plurality of the pixel circuits arranged in matrix, and the control portion further includes: a preceding line memory for storing the value of the gray-level potential for one row of the plurality of the pixel circuits; and a lookup table for outputting the value of the precharge potential based on the value of the gray-level potential, which is input from outside the control portion, and the value of the gray-level potential in a previous row, which is output from the preceding line memory.

(3) The display device according to item (1), further including: a plurality of first wiring lines for transmitting the difference data to the image signal line driving circuit from the difference acquiring circuit; and a plurality of second wiring lines for transmitting the value of the gray-level potential to the image signal line driving circuit from the control portion, in which the plurality of first wiring lines are smaller in number than the plurality of second wiring lines.

(4) A display device, including: a control portion; a display panel including one or more pixel circuits and an image signal line connected to the pixel circuits; and an image signal line driving circuit, in which: the control portion includes: a difference acquiring circuit for acquiring difference data between a value of a gray-level potential, which is to be applied to one of the pixel circuits from the image signal line, and a value of a precharge potential based on the gray-level potential; and a time-division transmitting section for transmitting the value of the gray-level potential and the difference data in sequence to the image signal line driving circuit; and the image signal line driving circuit includes: a time-division receiving section for receiving the value of the gray-level potential and the difference data from the time-division transmitting section; a calculating section for calculating the value of the precharge potential based on the value of the gray-level potential and the difference data received by the time-division receiving section; and an image signal line output section for supplying the image signal line with the precharge potential and the gray-level potential in sequence based on a calculation result of the calculating section.

(5) The display device according to item (4), in which the display panel includes a plurality of the pixel circuits arranged in matrix, and the control portion further includes: a preceding line memory for storing the value of the gray-level potential for one row of the plurality of the pixel circuits; and a lookup table for outputting the value of the precharge potential based on the value of the gray-level potential, which is input from outside the control portion, and the value of the gray-level potential in a previous row, which is output from the preceding line memory.

(6) The display device according to item (4), in which the control portion further includes: a plurality of first wiring lines for transmitting the difference data to the time-division transmitting section from the difference acquiring circuit; and a plurality of second wiring lines for transmitting the value of the gray-level potential, which is acquired from outside the control portion, to the time-division transmitting section, and the plurality of first wiring lines are smaller in number than the plurality of second wiring lines.

(7) A display device, including: a control portion; a display panel including one or more pixel circuits and an image signal line connected to the pixel circuits; and an image signal line driving circuit, in which the control portion includes a difference acquiring circuit for acquiring difference data between a value of a gray-level potential, which is to be applied to one of the pixel circuits from the image signal line, and a value of a precharge potential based on the gray-level potential, and the image signal line driving circuit includes: a calculating section for calculating the value of the gray-level potential based on the value of the precharge potential and the difference data; and an image signal line output section for supplying the image signal line with the precharge potential and the gray-level potential in sequence based on a calculation result of the calculating section.

According to the present invention, when the precharge potential and the gray-level potential are supplied to the image signal line in succession during a certain period, it is possible to suppress the increase in amount of information to be input to the image signal line driving circuit.

BRIEF DESCRIPTION OF THE DRAWINGS

In the accompanying drawings:

FIG. 8 is a table illustrating another example of an internal configuration of the lookup table in the example of FIG. 7;

DETAILED DESCRIPTION OF THE INVENTION

Hereinafter, embodiments of the present invention are described with reference to the accompanying drawings. Components appearing herein with the same functions are denoted by the same reference symbols, and description thereof is omitted. Described below is an example of applying the present invention to a liquid crystal display device as a type of display device.

First Embodiment

A liquid crystal display device according to a first embodiment of the present invention includes a liquid crystal display panel, and the liquid crystal display panel is structured to include an array substrate on which pixel circuits PC and the like are formed, a counter substrate provided opposed to the array substrate, liquid crystal sealed between the array substrate and the counter substrate, and an integrated circuit package disposed on the array substrate. Note that, polarizers are attached outside the array substrate and outside the counter substrate.

Figure 1:
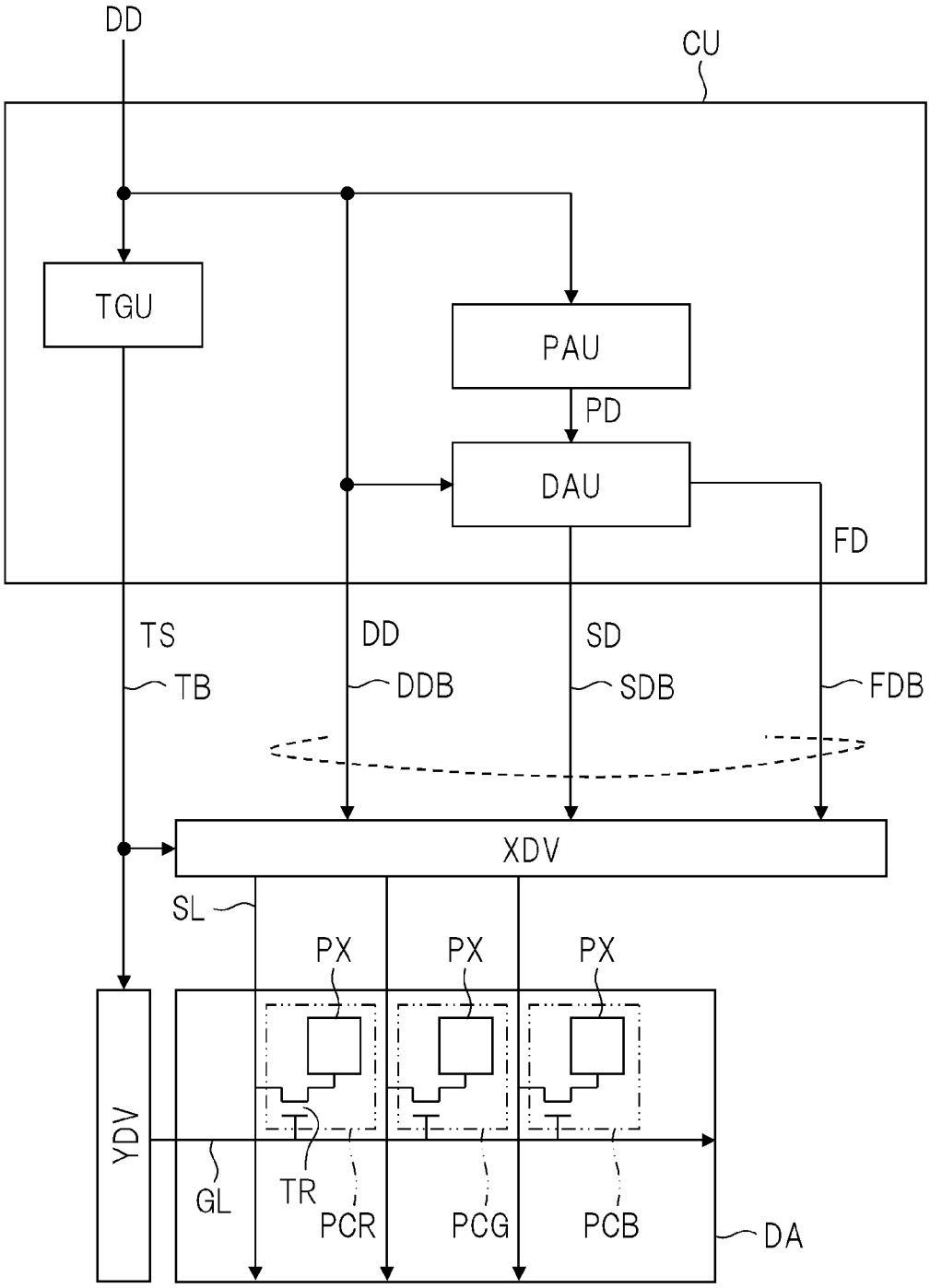
FIG. 1 is a diagram illustrating an example of a liquid crystal display device according to a first embodiment of the present invention.

FIG. 1 is a diagram illustrating an example of the liquid crystal display device according to the first embodiment. The liquid crystal display device according to this embodiment includes a control board CU, an image signal line driving circuit XDV, a vertical scanning circuit YDV, a display area DA, a plurality of image signal lines SL, and a plurality of scanning lines GL. The image signal line driving circuit XDV, the vertical scanning circuit YDV, the display area DA, the plurality of image signal lines SL, and the plurality of scanning lines GL are disposed on the array substrate in the liquid crystal display panel. In the display area DA, the plurality of pixel circuits PC are arranged in matrix. The scanning lines GL extend in the lateral direction of FIG. 1 side by side in the display area DA, and one end of each scanning line GL is connected to the vertical scanning circuit YDV. The image signal lines SL extend in the longitudinal direction of FIG. 1 side by side in the display area DA, and one end of each image signal line SL is connected to the image signal line driving circuit XDV. The pixel circuits PC are each provided in correspondence with the intersection between the image signal line SL and the scanning line GL. The liquid crystal display device according to this embodiment is a color liquid crystal display device, in which the pixel circuits PC are classified into three kinds of pixel circuits PCR for red display, pixel circuits PCG for green display, and pixel circuits PCB for blue display. Every three pixel circuits PCR, PCG, and PCB are arranged in the lateral direction to display one pixel. Note that, the screen resolution in the example of this embodiment is 1,920 columns×1,080 rows. The number of pixel circuits PC in the display area DA is (1,920×3) columns×1,080 rows. The image signal lines SL are present in correspondence with columns of the pixel circuits PC, and the pixel circuits PC are each connected to a corresponding image signal line SL.

The pixel circuits PC each include a pixel electrode PX and a pixel transistor TR. The pixel electrode PX is connected to a drain electrode of the pixel transistor TR. A source electrode of the pixel transistor TR is connected to the image signal line SL corresponding to the pixel circuit PC including the pixel transistor TR. The pixel transistor TR is a thin film transistor. The thin film transistor itself has no polarity between the source electrode and the drain electrode, and hence, generally, which one of the electrodes is defined as the source electrode or the drain electrode is determined for convenience based on the relationship of supplied potentials. Accordingly, the connection destinations of the source electrode and the drain electrode of the pixel transistor may be reversed. The pixel electrode PX is opposed to a counter electrode provided on the counter substrate. Based on an electric field generated between the pixel electrode PX and the counter electrode, the liquid crystal changes the amount of light transmitting through the pixel circuits PC, thereby changing display gray levels.

The control board CU includes a timing generating section TGU, a precharge potential calculating section PAU, and a difference acquiring section DAU. The control board CU is supplied with display data DD, and the display data DD is input to the timing generating section TGU and the precharge potential calculating section PAU. Based on the display data DD, the timing generating section TGU supplies a timing control signal TS, including a horizontal synchronization signal and a vertical synchronization signal, to the image signal line driving circuit XDV and the vertical scanning circuit YDV via a timing control bus TB. The display data DD is data containing a value of a gray-level potential to be applied from each image signal line SL to a corresponding pixel circuit PC. In the example of FIG. 1, the display data DD on a certain pixel circuit PC is digital data indicating the value of the gray-level potential to be supplied to each pixel circuit PC in 256 levels of 0 to 255. When the value of the gray-level potential of the display data DD on the certain pixel circuit PC (hereinafter, referred to as value of display data DD) is n, the gray-level potential is determined by ($V_o$+n×H/255), where $V_o$ is a gray-level potential given for the value of the display data DD of 0, and H is a potential difference between a gray-level potential given for the value of the display data DD of 255 and the gray-level potential $V_o$. In the display data DD for one screen, pieces of data on the respective pixel circuits PC are arranged in the order of row scanning from the upper left. Specifically, when the value of the display data DD on the pixel circuit PC in the n-th row and the m-th column is DD(n,m), the display data DD for one screen in a certain frame contains pieces of data arranged in the order of DD (1, 1), DD (1, 2), . . . , DD(1,m), DD(2,1), . . . , and DD(n,m).

The precharge potential calculating section PAU calculates, based on the input value of the display data DD, a value of a precharge potential $V_c$ to be applied to the image signal line SL, and outputs the calculated value of the precharge potential $V_c$ as precharge data PD. A specific method of calculating the precharge potential $V_c$ is described later. The precharge data PD is also digital data, and a precharge potential $V_c$ given for the value of n is expressed by the same expression as that of the gray-level potential.

The difference acquiring section DAU acquires, based on the display data DD and the precharge data PD, difference data between the gray-level potential indicated by the display data DD and the precharge potential $V_c$ calculated by the precharge potential calculating section PAU. In this embodiment, the difference data is the difference between a value of display data and a value of precharge data. In the example of FIG. 1, the difference data contains sign data FD indicating the sign of the difference and differential data SD indicating the absolute value of the difference.

The array substrate and the control board CU are physically connected to each other via a flexible printed circuit board (FPC). The timing control bus TB, a display data bus DDB, a differential data bus SDB, and a sign data bus FDB are a wiring group physically lying on the flexible printed circuit board. Wiring lines in the timing control bus TB dedicate for signals such as the horizontal synchronization signal and the vertical synchronization signal respectively. Each width of the display data bus DDB, the differential data bus SDB, and the sign data bus FDB (the number of included wiring lines) is determined based on the size of data to be transferred via the bus. For example, the display data bus DDB includes eight wiring lines because the display data DD for one pixel circuit PC is 8-bit data indicating 0 to 255.

Figures 2, 3:
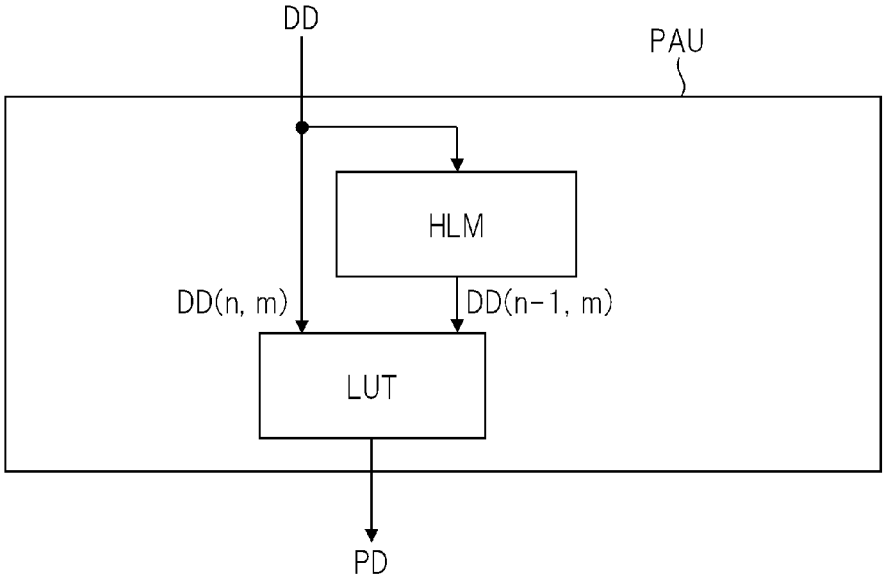
FIG. 2 is a diagram illustrating an example of a precharge potential calculating section in the example of FIG. 1.
FIG. 3 is a table illustrating an example of an internal configuration of a lookup table in the example of FIG. 1.

FIG. 2 is a diagram illustrating an example of the precharge potential calculating section PAU in the example of FIG. 1. The precharge potential calculating section PAU includes a preceding line memory HLM and a lookup table LUT. The preceding line memory HLM is a first-in first-out memory circuit for storing the display data DD for one row of the pixel circuits PC. When the display data DD(n,m) in the n-th row and the m-th column is input to the preceding line memory HLM, the preceding line memory HLM stores the display data DD(n,m), and outputs the display data DD(n−1,m) in the previous row and the same column. The lookup table LUT outputs a value of the precharge potential $V_c$ based on the display data DD(n,m), which is input from outside the control board CU, and the display data DD(n−1,m) in the previous line, which is output from the preceding line memory HLM. The lookup table LUT uses the value of the display data DD(n,m) and the value of the display data DD(n−1,m) as keys to acquire a value of the corresponding precharge potential $V_c$, and outputs the acquired value as the precharge data PD.

The lookup table LUT needs to store pieces of the precharge data PD calculated in advance for matrix combinations of the display data DD(n,m) and the display data DD(n−1,m), but does not always need to store pieces of the precharge data PD for all the possible combinations of the values of the display data DD(n,m) and the values of the display data DD(n−1,m). FIG. 3 is a table illustrating an example of an internal configuration of the lookup table LUT. The lookup table LUT of FIG. 3 stores pieces of the precharge data PD given for nine values of each of the display data DD(n,m) and the display data DD(n−1,m). The nine values are selected at almost regular intervals from the values of 0 to 255. Note that, in FIG. 3, some fields of the precharge data PD given for the display data DD(n,m) and the display data DD(n−1,m) are blank, but practically, values are set in the fields. Precharge data PD corresponding to a combination of pieces of the display data DD that are not stored is determined by interpolation with values of the precharge data PD corresponding to values of the display data DD near the combination. This way, the number of precharge potentials $V_c$ stored in the matrix table is 9×9=81, with the result that the amount of memory is significantly reduced as compared with 65,536 precharge potentials $V_c$ for complete memory. For example, in FIG. 3, when DD(n−1,m) is 0 and DD(n,m) is 224, the precharge data PD takes a value of 260, and when DD(n−1,m) is 11 and DD(n,m) is 32, the precharge data PD takes a value of 37, which is determined by interpolation with the values of DD(n−1,m) of 0 and 32. The reason why the precharge data PD is determined by the display data DD(n,m) and the display data DD(n−1,m) is that data indicating a potential supplied to the image signal line SL before supplying a potential to the pixel circuit PC in the n-th row and the m-th column is DD(n−1,m).

As described above, in the example of FIG. 1, the difference acquiring section DAU calculates the difference between the display data DD and the precharge data PD, and acquires the differential data SD and the sign data FD indicating the difference as the difference data thereof. In the example of FIG. 1, the absolute value of the difference between the display data DD and the precharge data PD is less than 64 gray levels. Therefore, the differential data SD can be represented by 6 bits. The sign data FD is 1-bit data. Note that, the maximum value of the absolute value of the difference, which varies depending on the characteristics of the liquid crystal display panel, is generally smaller than a gray level of the precharge potential $V_c$ itself.

Figure 4:
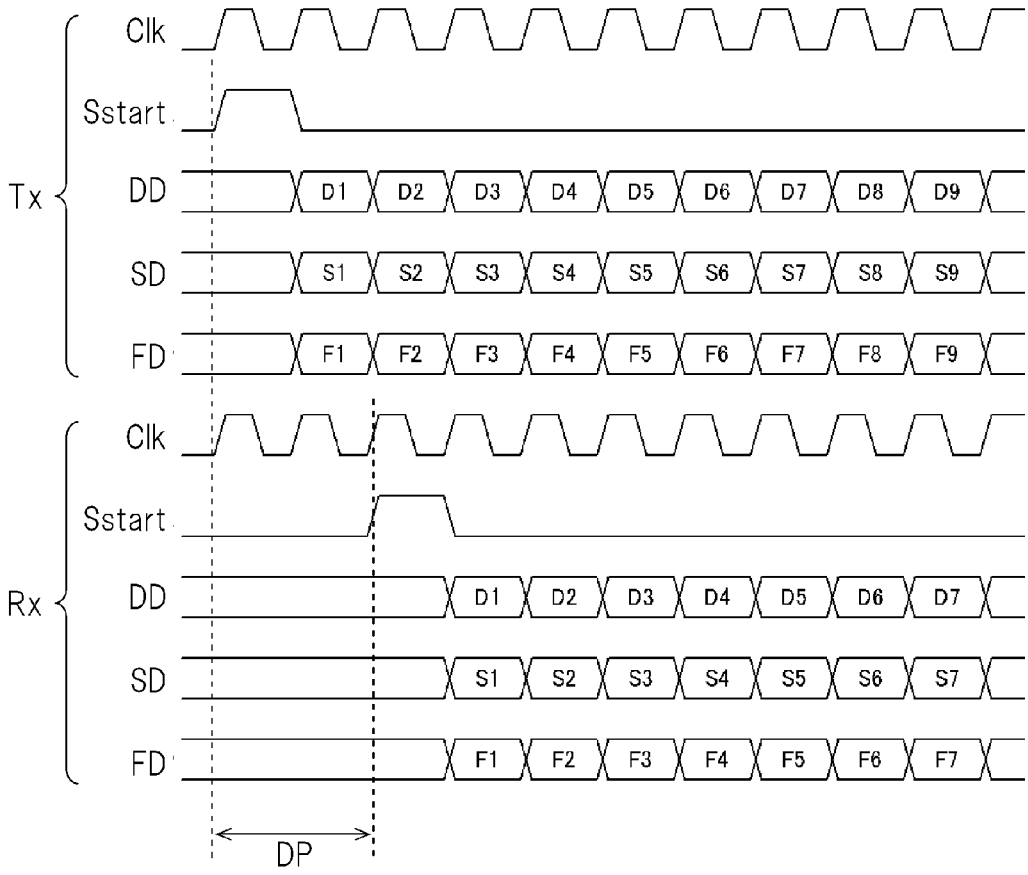
FIG. 4 is a diagram illustrating a transmission signal transmitted by a control board and a reception signal received by an image signal line driving circuit.

Then, the control board CU inputs the input display data DD, the differential data SD, the sign data FD, and the timing control signal TS to the image signal line driving circuit XDV via the flexible printed circuit board. FIG. 4 is a diagram illustrating a transmission signal Tx transmitted by the control board CU and a reception signal Rx received by the image signal line driving circuit XDV. FIG. 4 illustrates a clock Clk and a transfer start signal Sstart, which are contained in the timing control signal TS, the display data DD, the differential data SD, and the sign data FD. The transmitted contents and the received contents are substantially the same, but the timings are different by a time lag corresponding to a transfer period DP from the transmission by the control board CU to the reception by the image signal line driving circuit XDV. In this embodiment, because of very high-speed data transfer, the transfer period DP is longer than a period for transmitting data on one pixel circuit PC. In FIG. 4, Dk (k is an integer of 1 or more) is display data DD assigned to the pixel circuit PC in the k-th column among the display data DD of a certain row, Sk is differential data SD assigned to the pixel circuit PC in the k-th column thereamong, and Fk is the sign data FD assigned to the pixel circuit PC in the k-th column thereamong. In this embodiment, the display data DD, the differential data SD, and the sign data FD are transmitted in parallel at one clock cycle. In this case, 15 bits in total are transmitted at a time, including 8 bits for transmitting the display data DD, 6 bits for transmitting the differential data SD, and 1 bit for transmitting the sign data FD. Accordingly, fifteen wiring lines for data transfer are disposed on the flexible printed circuit board between the control board CU and the image signal line driving circuit XDV. Note that, the precharge data PD in the example of FIG. 4 is represented by 9 bits because the precharge data PD has more than 256 gray levels. Accordingly, if both of the display data DD and the precharge data PD are transmitted, seventeen wiring lines are necessary. In this embodiment, the difference data is transmitted so as to suppress the increase in data amount, with the result that two wiring lines are eliminated as compared with the case of transmitting the precharge data PD itself.

Figure 5:
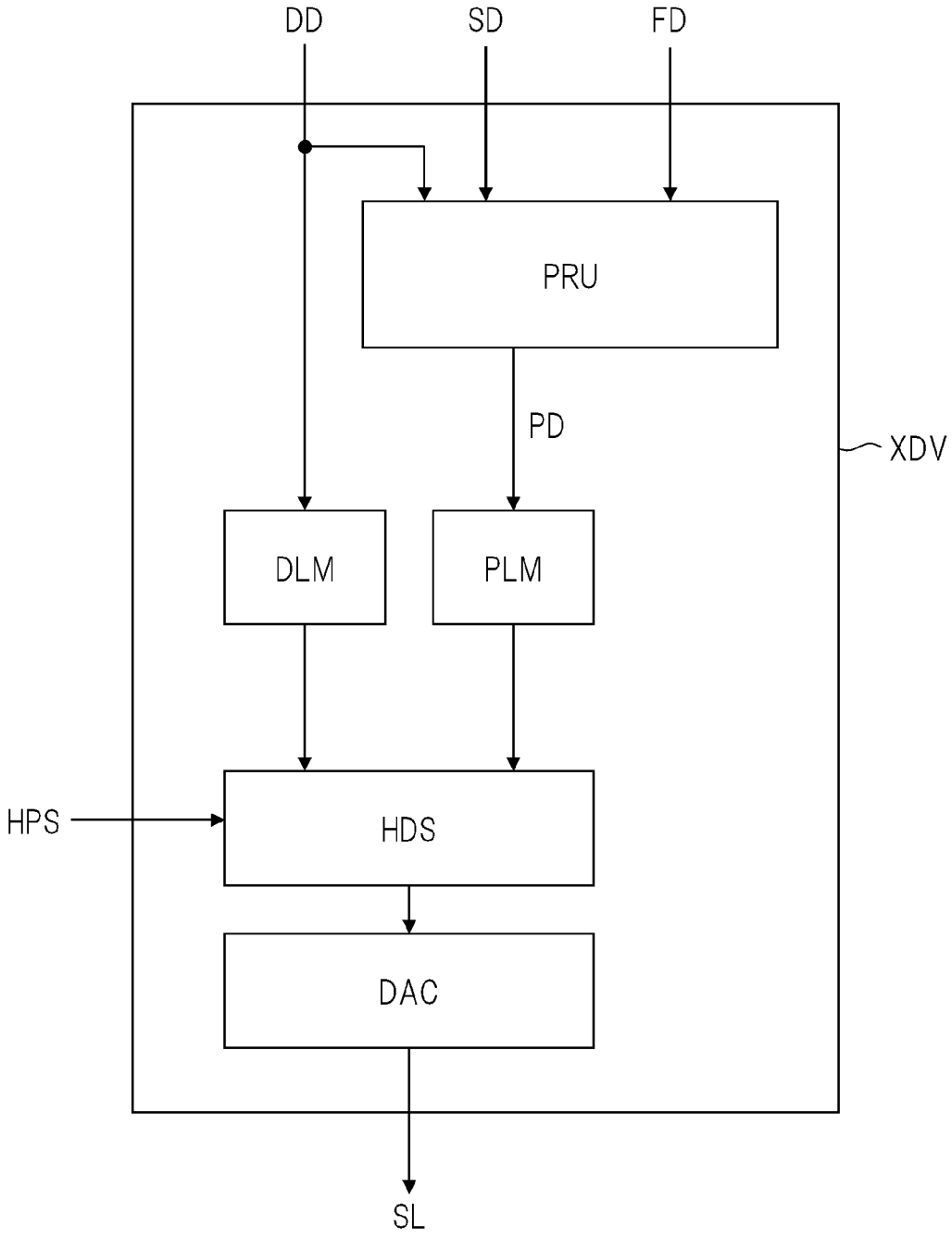
FIG. 5 is a diagram illustrating an example of the image signal line driving circuit in the example of FIG. 1.

FIG. 5 is a diagram illustrating an example of the image signal line driving circuit XDV in the example of FIG. 1. The image signal line driving circuit XDV includes a calculating section PRU, a display data memory DLM, a precharge data memory PLM, a data output selector HDS, and an image signal line output section DAC. The display data memory DLM is a first-in first-out memory device for storing the display data DD for one row which is input from the control board CU via the display data bus DDB. The calculating section PRU calculates a value of the precharge potential $V_c$ based on the display data DD, and the differential data SD and the sign data FD indicating the difference, which are input from the control board CU. More specifically, when the sign data FD indicates the positive (e.g., 0), the differential data SD is added to the display data DD on a certain pixel circuit PC, whereas when the sign data FD indicates the negative (e.g., 1), the differential data SD is subtracted therefrom, to thereby calculate the value of the precharge potential $V_c$, namely the precharge data PD.

The precharge data PD as a result of the calculation is stored in the precharge data memory PLM. The precharge data memory PLM is a first-in first-out memory device for storing the precharge data PD for one row. Based on a half horizontal synchronization signal HPS having a cycle of ½ a horizontal scanning period, the data output selector HDS selects which one of the display data DD from the display data memory DLM and the precharge data PD is to be input to the image signal line output section DAC, every period of ½ the horizontal scanning period (hereinafter, referred to as half period). In a certain horizontal scanning period, the precharge data PD for one row and the display data DD for one row are output from the data output selector HDS in sequence. Note that, the precharge data PD and the display data DD are each input to the image signal line output section DAC within a half of the certain horizontal scanning period, and hence the transfer rate between the data output selector HDS and the image signal line output section DAC is set so that each of the precharge data PD and the display data DD for one row may be transferred within the half period. The image signal line output section DAC latches the input precharge data PD for one row in the first half period of the certain horizontal scanning period. In the second half period, the image signal line output section DAC outputs a precharge potential $V_c$ obtained by converting the latched precharge data PD from analog to digital, to a corresponding image signal line SL. Further, the image signal line output section DAC latches the display data DD for one row that is input in the second half period of the certain horizontal scanning period. In the first half period of the next horizontal scanning period, the image signal line output section DAC outputs a gray-level potential obtained by converting the latched display data DD from digital to analog, to the image signal line SL. Each image signal line SL is supplied with the precharge potential $V_c$ and the gray-level potential in succession from the image signal line output section DAC.

Figure 6:
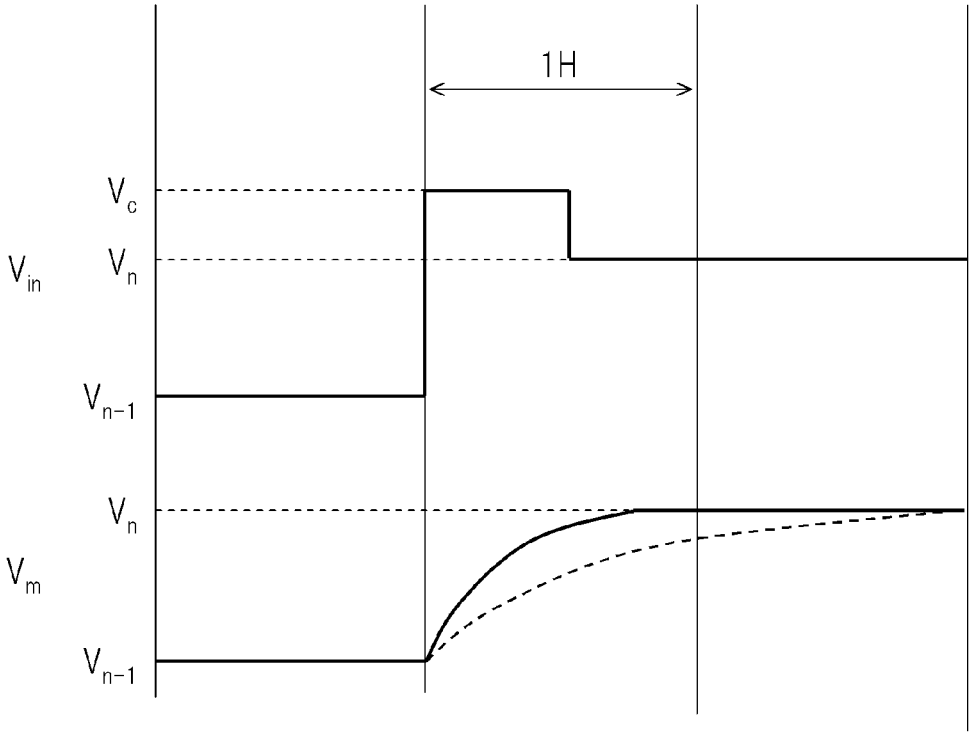
FIG. 6 is a diagram illustrating changes in potential of an image signal line when a precharge potential and a gray-level potential are input in sequence during a horizontal period.

FIG. 6 is a diagram illustrating changes in potential of the image signal line SL when the precharge potential $V_c$ and the gray-level potential are input in succession during a horizontal period 1H. FIG. 6 illustrates temporal changes in a potential $V_{in}$ applied from the image signal line driving circuit XDV and a measured potential $V_m$ of the image signal line SL. If the potential of the image signal line SL before the start of the certain horizontal period 1H is $V_{n-1}$, when the precharge potential $V_c$ is applied for the half period, the potential $V_m$ changes rapidly as compared with the case of simply applying the gray-level potential $V_n$ (indicated by the broken line of FIG. 6). In the next half period, the gray-level potential $V_c$ is applied so that the potential $V_m$ changes asymptotically toward the gray-level potential $V_n$. This way, when the precharge potential $V_c$ is applied to the image signal line SL, the potential of the image signal line SL becomes closer to the gray-level potential as compared with when the gray-level potential is applied as it is.

Figure 7:
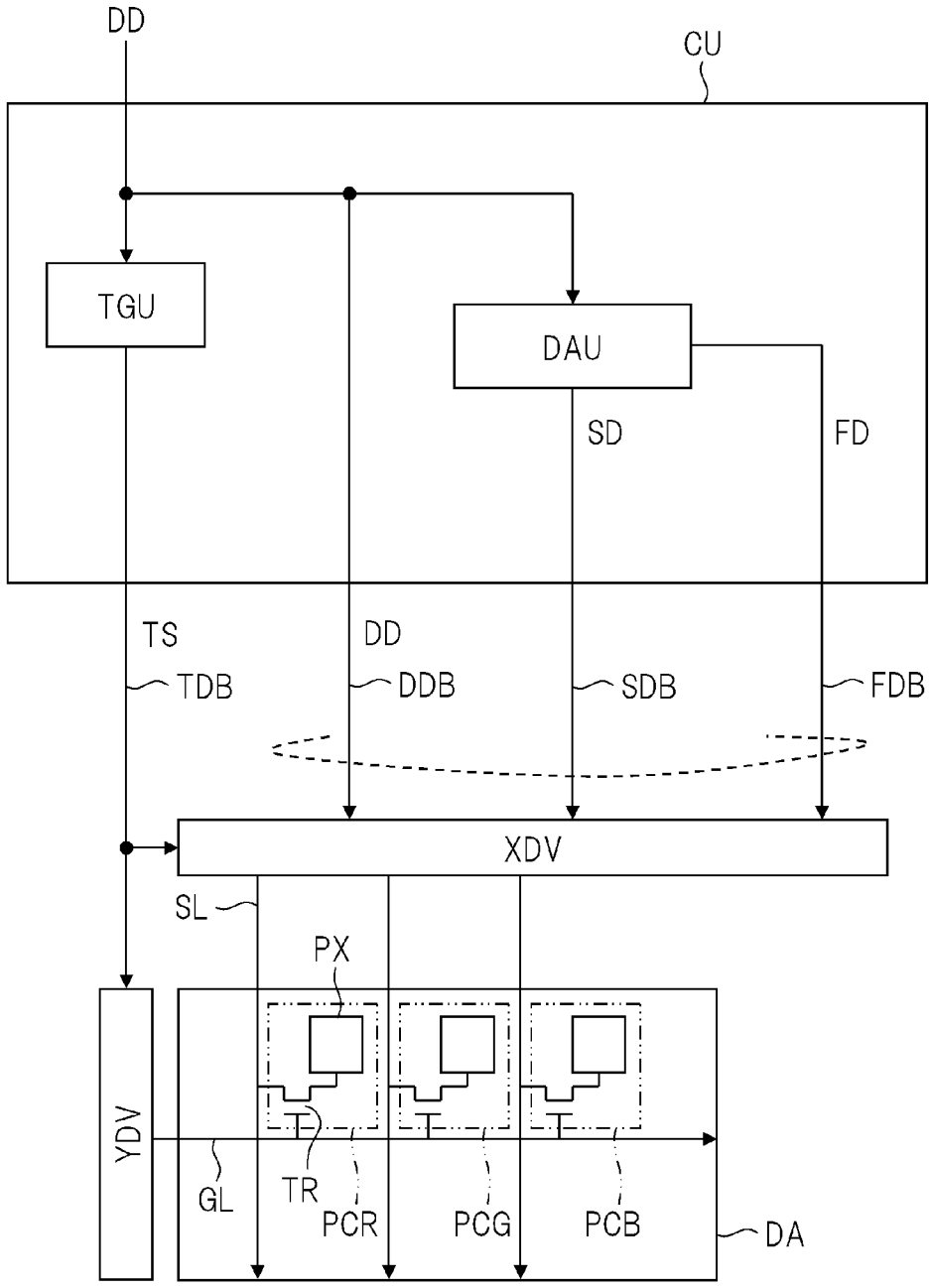
FIG. 7 is a diagram illustrating another example of the liquid crystal display device according to the first embodiment.

Note that, in the example of the above-mentioned embodiment, the value of the precharge potential $V_c$ is determined and thereafter the difference data between the value of the gray-level potential and the value of the precharge potential $V_c$ is acquired, but the difference data may be acquired directly without determining the value of the precharge potential $V_c$. FIG. 7 is another example of the liquid crystal display device according to the first embodiment. FIG. 7 is different from the example of FIG. 1 in that the display data DD is input to the difference acquiring section DAU.

The difference acquiring section DAU has a similar configuration to that of the precharge potential calculating section PAU in the example of FIG. 2, and includes the preceding line memory HLM of fast-in fast-out type for storing the display data DD for one row, and the lookup table LUT. The difference from the configuration of FIG. 2 resides in that the lookup table LUT outputs the differential data SD and the sign data FD. The lookup table LUT uses the display data DD(n,m) and DD(n−1,m) as keys to acquire the differential data SD and the sign data FD indicating the difference between a value of the gray-level potential and a value of the precharge potential $V_c$. FIG. 8 is a table illustrating another example of an internal configuration of the lookup table LUT. The lookup table LUT of FIG. 8 stores pieces of the differential data SD and the sign data FD given for combinations of nine values of each of the display data DD(n,m) and the display data DD(n−1,m). In practice, blank fields of the precharge data PD given for combinations of the display data DD(n,m) and the display data DD(n−1,m) have values, which is the same as FIG. 3. For example, when DD(n−1,m) is 0 and DD(n,m) is 224, the differential data SD takes a value of 36 and the sign data FD takes a value of 0. Similarly to the example of FIG. 3, differential data SD and sign data FD corresponding to a combination of pieces of the display data DD that are not stored are determined by interpolation. With this configuration, there is no need for the control board CU to calculate the value of the precharge potential $V_c$, thereby reducing a circuit scale of the control board CU.

Further, instead of transmitting the display data DD, and the differential data SD and the sign data FD as the difference data described above, the precharge data PD and the difference data may be transmitted. There is however a fear that the amount of information to be transmitted is increased because the precharge data PD has a wider range of possible values than that of the display data DD. In this case, the calculating section PRU calculates the display data DD based on the precharge data PD and the difference data.

Second Embodiment

A second embodiment of the present invention is different from the first embodiment mainly in that a different data transfer method is employed between the control board CU and the image signal line driving circuit XDV. Hereinafter, the difference from the first embodiment is mainly described.

Figure 9:
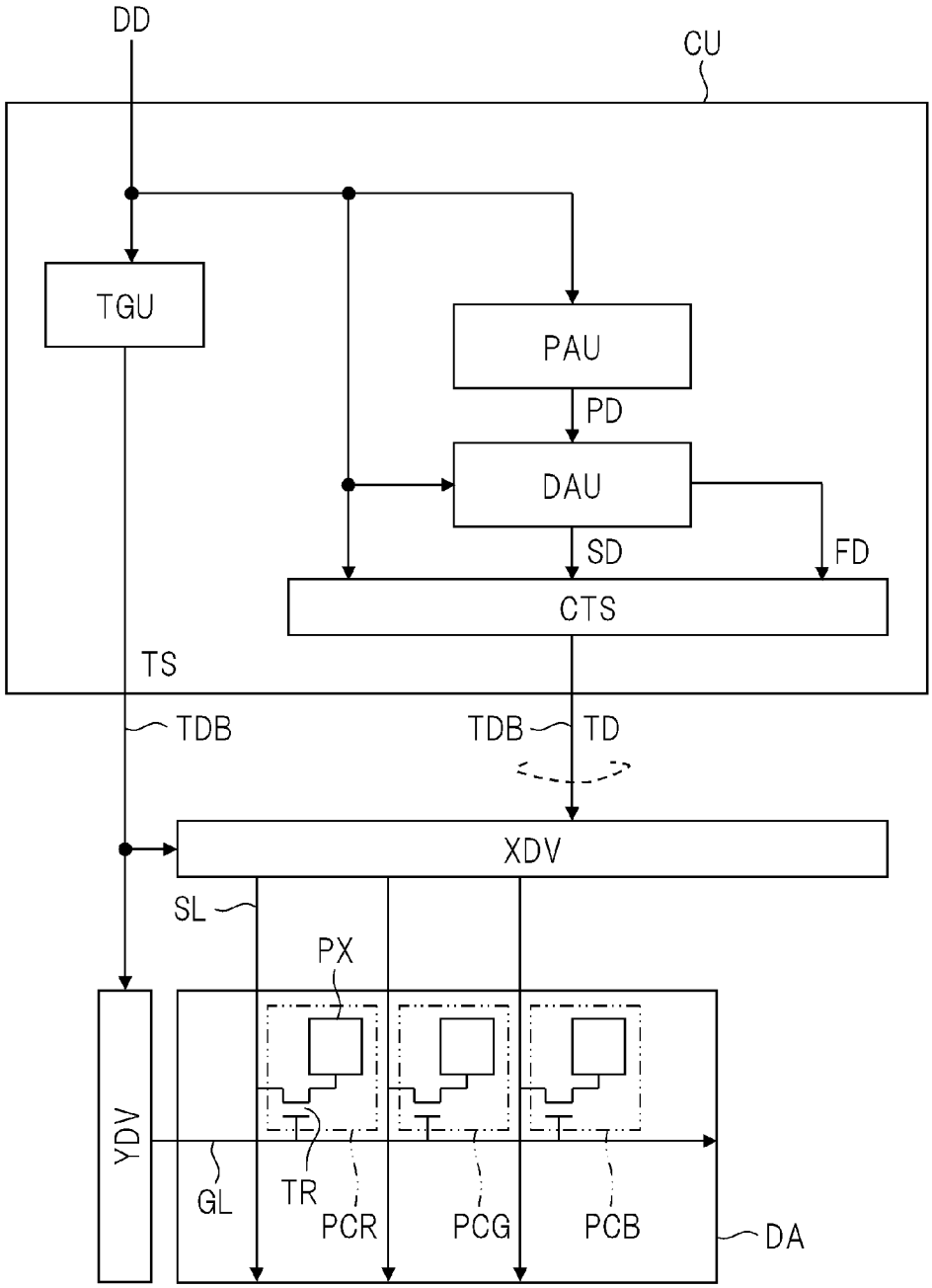
FIG. 9 is a diagram illustrating an example of a liquid crystal display device according to a second embodiment of the present invention.
Figure 10:
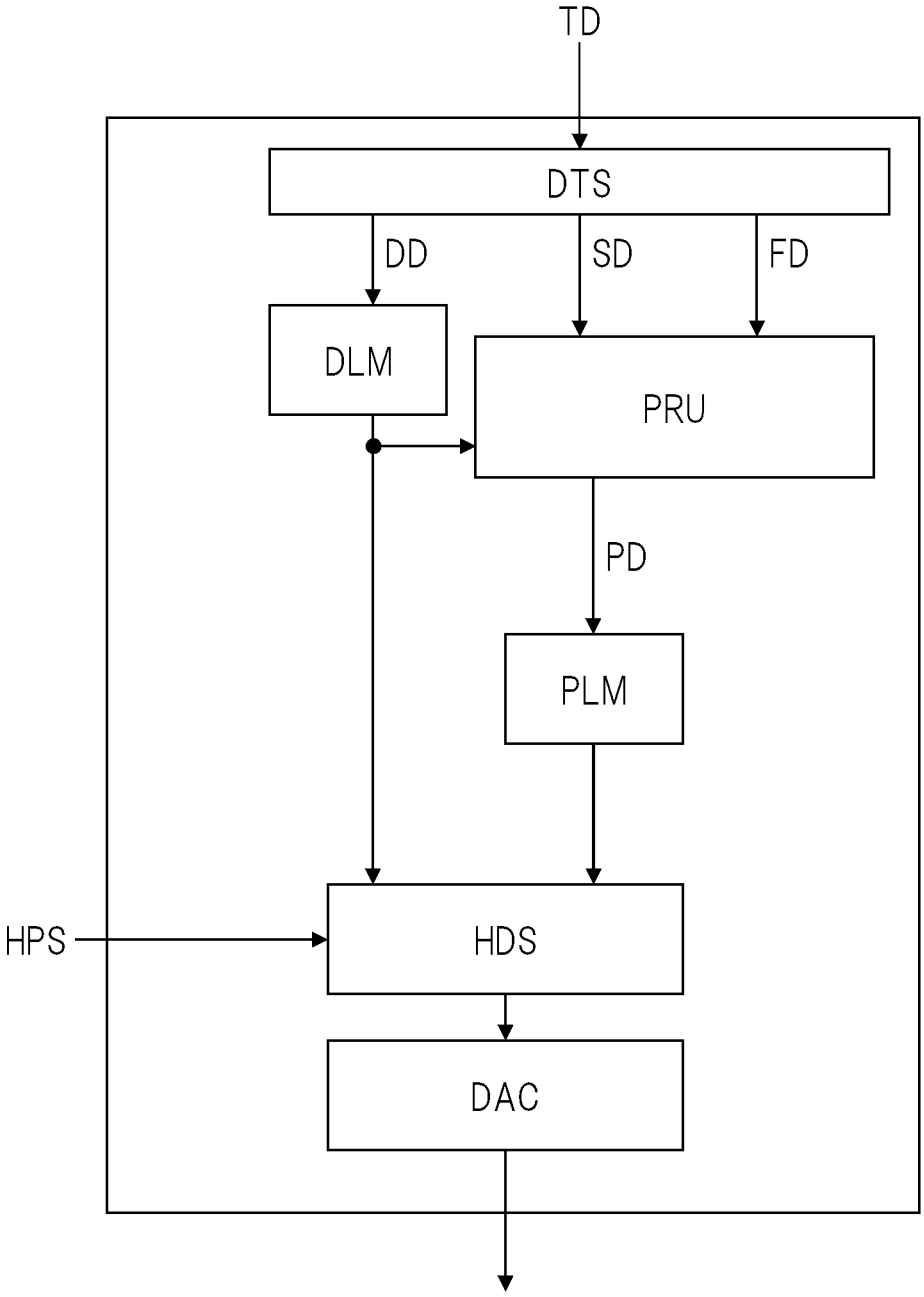
FIG. 10 is a diagram illustrating an example of an image signal line driving circuit in the example of FIG. 10.

FIG. 9 is a diagram illustrating an example of a liquid crystal display device according to the second embodiment, which corresponds to FIG. 1 of the first embodiment. FIG. 10 is an example of an image signal line driving circuit XDV according to the second embodiment, which corresponds to FIG. 5 of the first embodiment. The main difference from the liquid crystal display device illustrated in FIG. 1 and FIG. 5 resides in that the control board CU further includes a time-division transmitting section CTS and the image signal line driving circuit XDV further includes a time-division receiving section DTS.

The time-division transmitting section CTS is supplied with the display data DD input to the control board CU, and the differential data SD and the sign data FD from the difference acquiring section DAU. The time-division transmitting section CTS transmits the display data DD, the differential data SD, and the sign data FD to the image signal line driving circuit XDV in sequence on a row basis. The display data DD contains the value of the gray-level potential, and the differential data SD and the sign data FD indicate the difference data between the value of the gray-level potential and the value of the precharge potential $V_c$. In this embodiment, unlike the example of FIG. 1, a time-division data bus TDB is provided between the control board CU and the image signal line driving circuit XDV, in place of the display data bus DDB, the differential data bus SDB, and the sign data bus FDB. The display data DD, the differential data SD, and the sign data FD are transferred via the time-division data bus TDB. Hereinafter, the data transferred via the time-division data bus TDB is referred to as time-division data TD. Note that, the difference acquiring section DAU, the precharge potential calculating section PAU, and the timing generation section TGU included in the control board CU have the same configurations as those of the example of FIG. 1.

Figure 11:
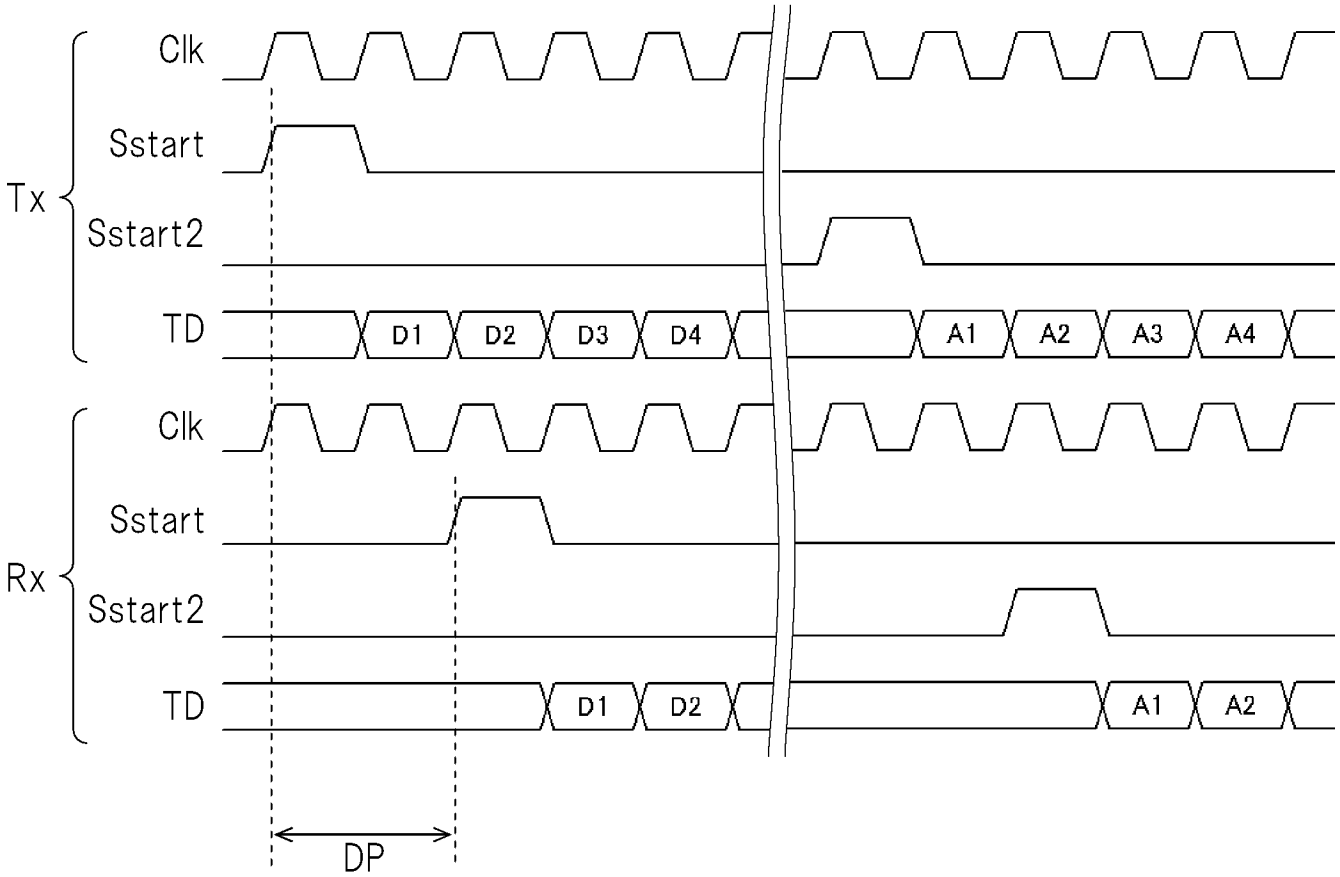
FIG. 11 is a diagram illustrating a transmission signal transmitted by a control board and a reception signal received by the image signal line driving circuit.

The time-division receiving section DTS included in the image signal line driving circuit XDV receives the time-division data TD from the control board CU via the time-division data bus TDB. FIG. 11 is a diagram illustrating a transmission signal Tx transmitted by the control board CU and a reception signal Rx received by the image signal line driving circuit XDV. FIG. 11 corresponds to FIG. 4 of the first embodiment. FIG. 11 illustrates, as the timing control signal TS, a clock Clk, a transfer start signal Sstart, and a data type switch signal Sstart2. In FIG. 11, Ak (k is an integer of 1 or more) is differential data SD and sign data FD assigned to the pixel circuit PC in the k-th column. The clock Clk has a frequency twice that of the first embodiment. The contents of the time-division data TD are the display data DD until immediately before the data type switch signal Sstart2 is changed to high level since the transfer start signal Sstart for starting data transfer of a certain row was changed to high level. Further, the contents of the time-division data TD are the differential data SD and the sign data FD until the transfer start signal Sstart for starting data transfer of a next row is changed to high level since the data type switch signal Sstart2 was changed to high level. Note that, the width of the time-division data bus TDB is 8 bits in correspondence with the display data DD, and the differential data SD and the sign data FD are transferred using 6+1=7 bits in the time-division data bus TDB.

The time-division receiving section DTS outputs the display data DD to the display data memory DLM when the contents of the time-division data TD are display data DD, and outputs the differential data SD and the sign data FD to the calculating section PRU when the contents of the time-division data TD are the differential data SD and the sign data FD. The calculating section PRU acquires the display data DD corresponding to the differential data SD and the sign data FD from the display data memory DLM, and calculates the precharge data PD with the same method as that of the first embodiment. The calculated precharge data PD is stored in the precharge data memory PLM. The data output selector HDS outputs the precharge data PD for one row and the display data DD for one row to the image signal line output section DAC in sequence. The image signal line output section DAC applies a potential to the image signal line SL similarly to the example of the first embodiment.

While there have been described what are at present considered to be certain embodiments of the invention, it will be understood that various modifications may be made thereto, and it is intended that the appended claims coverall such modifications as fall within the true spirit and scope of the invention.

For example, in the above-mentioned embodiments, a liquid crystal display device in which the counter electrode is disposed on the counter substrate (such as TN mode and VA mode) has been described, but it should be understood that the present invention is also applicable to an IPS mode liquid crystal display device, in which a common electrode corresponding to the counter electrode is disposed on the array substrate. Further, the present invention is also applicable to an organic electroluminescent (EL) display device. This is because such display devices suffer from the common problems due to common features that the pixel circuit is supplied with a potential using the image signal line SL and that the potential is supplied within a limited period.

While there have been described what are at present considered to be certain embodiments of the invention, it will be understood that various modifications may be made thereto, and it is intended that the appended claims cover all such modifications as fall within the true spirit and scope of the invention.

What is claimed is:

1. A display device, comprising:

a control portion;

a display panel comprising one or more pixel circuits and an image signal line connected to the pixel circuits; and an image signal line driving circuit;

wherein the control portion comprises a difference acquiring circuit for acquiring difference data between a value of a gray-level potential, which is to be applied to one of the pixel circuits from the image signal line, and a value of a precharge potential based on the gray-level potential, and wherein the image signal line driving circuit comprises:

a calculating section for calculating the value of the precharge potential based on the value of the gray-level potential and the difference data; and an image signal line output section for supplying the image signal line with the precharge potential and the gray-level potential in sequence based on a calculation result of the calculating section, wherein the display device further comprises:

a plurality of first wiring lines for transmitting the difference data to the image signal line driving circuit from the difference acquiring circuit; and a plurality of second wiring lines for transmitting the value of the gray-level potential to the image signal line driving circuit from the control portion, wherein the difference data comprise a sign data indicating a sign of the difference between the value of the gray-level potential and the value of the precharge potential and the differential data indicating an absolute value of the difference; and wherein the plurality of first wiring lines are smaller in number than the plurality of second wiring lines.

2. The display device according to claim 1, wherein the display panel comprises a plurality of the pixel circuits arranged in matrix; and wherein the control portion further comprises:

a preceding line memory for storing the value of the gray-level potential for one row of the plurality of the pixel circuits; and a lookup table for outputting the value of the precharge potential based on the value of the gray-level potential, which is input from outside the control portion, and the value of the gray-level potential in a previous row, which is output from the preceding line memory.

3. The display device according to claim 2, wherein the calculating section calculates the value of the precharge potential for each of the pixel circuits based on the value of the gray-level potential and the difference data.

4. The display device according to claim 1, wherein the display panel comprises a plurality of the pixel circuits arranged in matrix, and wherein the control portion further comprises;

a preceding line memory for storing the value of the gray-level potential for one row of the plurality of the pixel circuits; and a lookup table for outputting the difference data based on the value of the gray-level potential, which is input from outside the control portion, and the value of the gray-level potential in a previous row, which his output from the preceding line memory.

5. A display device, comprising:

a control portion;

a display panel comprising one or more pixel circuits and an image signal line connected to the pixel circuits; and an image signal line driving circuit;

wherein the control portion comprises:

a difference acquiring circuit for acquiring difference data between a value of a gray-level potential, which is to be applied to one of the pixel circuits from the image signal line, and a value of a precharge potential based on the gray-level potential; and a time-division transmitting section for transmitting the value of the gray-level potential and the difference data in sequence to the image signal line driving circuit; and wherein the image signal line driving circuit comprises:

a time-division receiving section for receiving the value of the gray-level potential and the difference data from the time-division transmitting section;

a calculating section for calculating the value of the precharge potential based on the value of the gray-level potential and the difference data received by the time-division receiving section; and an image signal line output section for supplying the image signal line with the precharge potential and the gray-level potential in sequence based on a calculation result of the calculating section;

wherein the control portion further comprises:

a plurality of first wiring lines for transmitting the difference data to the time-division transmitting section from the difference acquiring circuit; and a plurality of second wiring lines for transmitting the value of the gray-level potential, which is input from outside the control portion, to the time-division transmitting section;

wherein the difference data comprise a sign data indicating a sign of the different between the value of the gray-level potential and the value of the precharge potential and the differential data indicating an absolute value of the difference; and wherein the plurality of first wiring lines are smaller in number than the plurality of second wiring lines.

6. The display device according to claim 5, wherein the display panel comprises a plurality of the pixel circuits arranged in matrix; and wherein the control portion further comprises:

a preceding line memory for storing the value of the gray-level potential for one row of the plurality of the pixel circuits; and a lookup table for outputting the value of the precharge potential based on the value of the gray-level potential, which is input from outside the control portion, and the value of the gray-level potential in a previous row, which is output from the preceding line memory.

7. The display device according to claim 6, wherein the calculating section calculates the value of the precharge potential for each of the pixel circuits based on the value of the gray-level potential and the difference data.

8. The display device according to claim 5, wherein the display panel comprises a plurality of the pixel circuits arranged in matrix, and wherein the control portion further comprises:

a preceding line memory for storing the value of the gray-level potential for one row of the plurality of the pixel circuits; and a lookup table for outputting the difference data based on the value of the gray-level potential, which is input from outside the control portion, and the value of the gray-level potential in a previous row, which is output from the preceding line memory.

9. A display device, comprising:

a control portion;

a display panel comprising one or more pixel circuits and an image signal line connected to the pixel circuits; and an image signal line driving circuit;

wherein the control portion comprises a difference acquiring circuit for acquiring difference data between a value of a gray-level potential, which is to be applied to one of the pixel circuits from the image signal line, and a value of a precharge potential based on the gray-level potential; and wherein the image signal line driving circuit comprises:

a calculating section for calculating the value of the gray-level potential based on the value of the precharge potential and the difference data; and an image signal line output section for supplying the image signal line with the precharge potential and the gray-level potential in sequence based on a calculation result of the calculating section;

wherein the display device further comprises:

a plurality of first wiring lines for transmitting the difference data to the image signal line driving circuit from the difference acquiring circuit; and a plurality of second wiring lines for transmitting the value of the precharge potential to the image signal line driving circuit from the control portion;

wherein the difference data comprise a sign data indicating a sign of the difference between the value of the gray-level potential and the value of the precharge potential and the differential data indicating an absolute value of the difference; and wherein the plurality of first wiring lines are smaller in number than the plurality of second wiring lines.

10. The display device according to claim 9, wherein the display panel comprises a plurality of the pixel circuits arranged in matrix; and wherein the control portion further comprises:

a preceding line memory for storing the value of the gray-level potential for one row of the plurality of the pixel circuits; and a lookup table for outputting the value of the precharge potential based on the value of the gray-level potential, which is input from outside the control portion, and the value of the gray-level potential in a previous row, which is output from the preceding line memory.

11. The display device according to claim 10, wherein the calculating section calculates the value of the gray-level potential for each of the pixel circuits based on the value of the precharge potential and the difference data.

12. The display device according to claim 9, wherein the display panel comprises a plurality of the pixel circuits arranged in matrix, and wherein the control portion further comprises;

a preceding line memory for storing the value of the gray-level potential for one row of the plurality of the pixel circuits; and a lookup table for outputting the difference data based on the value of the gray-level potential, which is input from outside the control portion, and the value of the gray-level potential in a previous row, which his output from the preceding line memory.

* * * * *